United States Patent [19]

Owens

[11] 3,980,211

[45] Sept. 14, 1976

[54] POURING ADAPTOR-CLOSURE ASSEMBLY

[75] Inventor: Phillip J. Owens, Exton, Pa.

[73] Assignee: The West Company, Phoenixville, Pa.

[22] Filed: Feb. 19, 1975

[21] Appl. No.: 551,011

Related U.S. Application Data

[63] Continuation of Ser. No. 287,872, Sept. 11, 1972, abandoned, which is a continuation-in-part of Ser. No. 106,356, Jan. 14, 1971, abandoned.

[52] U.S. Cl. ..... 222/478; 222/547; 222/562

[51] Int. Cl.[2] ..... B65D 25/48

[58] Field of Search ..... 222/109, 478, 479, 498, 222/547, 562, 564, 566–570

[56] References Cited

UNITED STATES PATENTS

| | | | |
|---|---|---|---|
| 2,763,402 | 9/1956 | Livingstone | 222/570 X |
| 3,297,211 | 1/1967 | Unger | 222/567 X |
| 3,311,275 | 3/1967 | Gibson | 222/564 X |
| 3,319,842 | 5/1967 | Miller | 222/479 |
| 3,330,450 | 7/1967 | Clare | 222/567 X |
| 3,361,307 | 1/1968 | Clare | 222/567 X |
| 3,563,422 | 2/1971 | Cruikshank | 222/478 |

*Primary Examiner*—Robert B. Reeves
*Assistant Examiner*—Francis J. Bartuska
*Attorney, Agent, or Firm*—Howson and Howson

[57] ABSTRACT

A pouring adaptor adapted to be mounted over the open end in a container for liquid products comprising a central disc portion having a locking rib for securing the adaptor over the discharge opening in the container, a lower section depending into the container having a plurality of window-like discharge openings of a size and shape to control discharge of fluid therethrough and an upper generally cylindrical head section terminating in an outwardly flared lip and having flange members for detachably securing the adaptor to a closure.

31 Claims, 14 Drawing Figures

INVENTOR:
PHILLIP J. OWENS

BY
Howson & Howson

ATTYS.

INVENTOR:
PHILLIP J. OWENS
BY
Howson & Howson
ATTYS.

INVENTOR:
PHILLIP J. OWENS
BY
Howson & Howson
ATTYS.

POURING ADAPTOR-CLOSURE ASSEMBLY

This is a continuation, of application Ser. No. 287,872 filed Sept. 11, 1972 now abandoned, which is a Continuation-in-Part application of my prior copending application, Ser. No. 106,356 filed Jan. 14, 1971, entitled "Pouring Adaptor-Closure Assembly" now abandoned.

The present invention relates to new and improved non-drip pouring adaptors for use on containers for liquid products and more particularly to a new and improved closure-pouring adaptor assembly having novel features of construction and arrangement.

In the preferred form of the invention, the adaptor consists of a central disc-like section having a skirt with a locking rib or bead adapted to engage in a groove in the exterior wall of the neck of the container to mount the adaptor over the open end of the container, a lower section projecting into the mouth of the container and a head section including an outwardly directed flared pouring lip to facilitate pouring of liquid from the container in a non-drip fashion. The lower section includes a plurality of window-like discharge openings and a configuration to control flow of the fluid from the container so that it discharges at a predetermined controlled rate. The outer closure cap includes a central depending flange with an annular groove to receive a detent on the head section of the adaptor to normally maintain the adaptor and closure as an integral unit prior to assembly on the neck of the container. In accordance with the present invention, the seating force of the locking rib and groove in relation to the detent retaining means is such that the pouring adaptor remains seated over the open end of the container when the closure cap is removed.

The pouring adaptor-closure assembly of the present invention is of extremely simplified design and is adapted to be made of a resilient flexible material to facilitate easy assembly of the parts and the desired locking and release action described above. Additionally, the assembly is of a configuration to provide several effective seal areas to prevent leakage of fluid from containers employing linerless caps. Other functional features provided by the configuration arrangement of a pouring adaptor in accordance with the present invention include smooth flow of liquid through the adaptor without spurting and without "glugging." "Glugging" is the tendency of liquid to surge while being dispensed and this tendency is eliminated by use of the adaptor since air is continuously being replaced in the container through the adaptor. In the adaptor of the present invention, the configuration of the window-like discharge ports may be selectively chosen to provide the desired discharge flow rate. Finally, the adaptor has means to insure return flow of liquid when the bottle is placed in an upright position after use.

In one principal form of the invention, the lower section of the pouring adaptor includes a separate inner cap member which engages over the lower terminal ends of the circumferentially spaced finger portions. The cap is of a predetermined diameter in relation to the inside diameter of the neck to provide a controlled flow area for obtaining the desired flow of liquid from the body of the container through the window-like openings defined by the fingers. Additionally, the parts are constructed in a manner to facilitate assembly thereof by automatic equipment. For example, the terminal ends of the fingers are tapered to provide a camming action with the flanges defining the circumferential pocket of the inner cap so that the parts may be readily assembled. Additionally, the diameter of the skirt of the adaptor is sized in relation to the inside diameter of the cap which in combination with the flared lip of the head section provides for automatic location of the inner flange of the cap relative to the head section for assembly purposes. In other words, the adaptor serves as a funnel-like guide to receive the closure cap on assembly. Further, the locking rib has a flared lower terminal edge so that when it engages the exterior finish of the container on assembly a camming action results to deflect the skirt radially outwardly and permit the locking rib to seat in the groove on the neck of the container.

As outlined in more detail hereafter, the adaptor of the present invention not only lends itself well to assembly by automatic equipment of its various components, but is also readily adapted to assembly to a container by automatic capping equipment.

These and other objects of the present invention and the various features and details of the constructions and arrangement of a pouring adaptor-closure assembly are hereinafter more fully described with reference to the accompanying drawings wherein.

Figure 1:
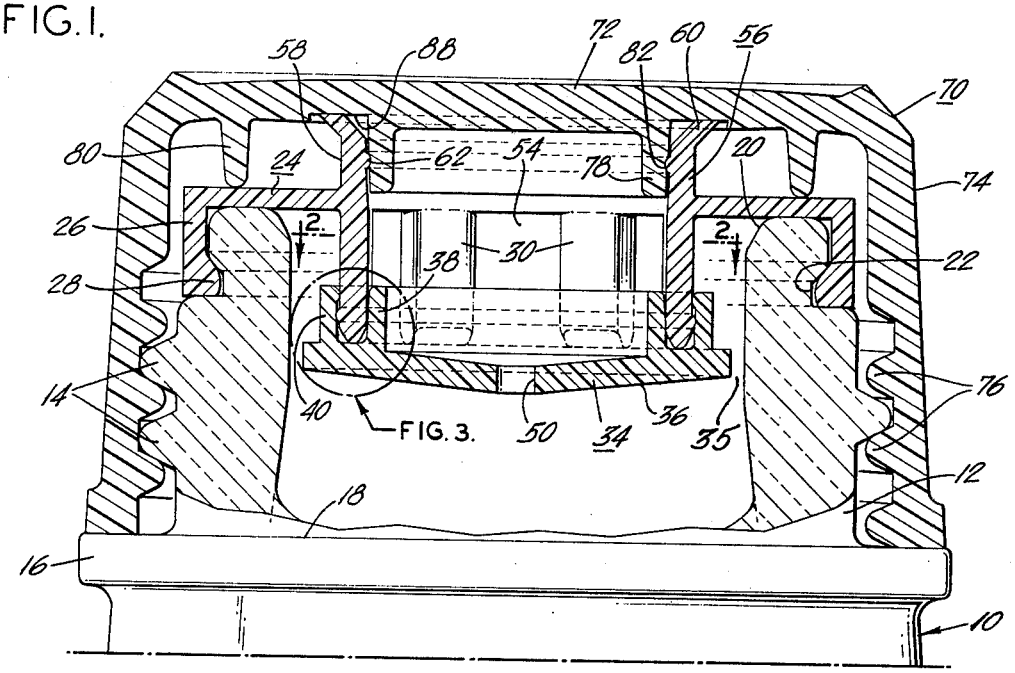
FIG. 1 is an elevational sectonal view of a combination pouring adaptor-closure assembly for a container shown in place on the neck of a container such as a bottle.

Referring now to the drawings and particularly to the embodiment of the invention illustrated in FIGS. 1–4 inclusive, there is illustrated a combination closure-pouring adaptor or fitment for a container for dispensing liquid products. The container, which is generally designated by the numeral 10, is a bottle and has, in the present instance, a reduced neck portion 12 with spiral threads 14 to receive a screw-type closure cap. The lower end of the neck terminates in a radially outwardly projecting shoulder 16, the upper surface 18 of which confronts the lower edge of the cap when fully seated. The exterior wall of the neck adjacent the discharge opening 20 is of a reduced diameter and is provided with an annular groove 22 to retain the pouring adaptor in the manner described below.

Figure 2:
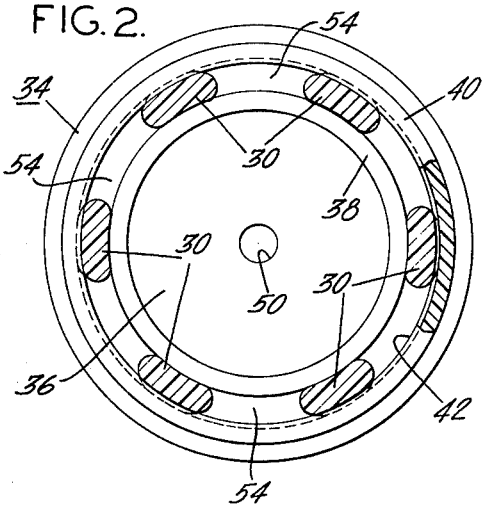
FIG. 2 is a sectional view taken on lines 2—2 of FIG. 1.
Figure 3:
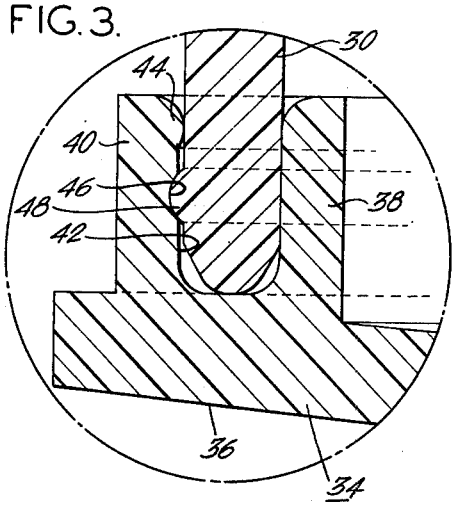
FIG. 3 is an enlarged or exploded view of the encircled area of FIG. 1.
Figure 4:
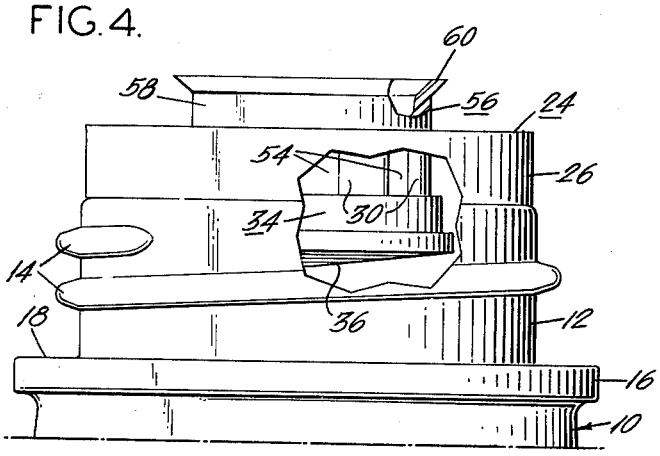
FIG. 4 is a side elevational view with parts broken away of the pouring adaptor with the closure cap removed.

The pouring adaptor comprises a ring-like central disc portion 24 which terminates at its outer edge in a depending cylindrical skirt 26, the skirt 26 in turn having an enlarged lower terminal edge defining a locking rib 28 which is adapted to seat in the groove 22 to retain the pourer over the open end of the container in the manner illustrated in FIG. 1. The pouring adaptor further includes a lower section 29 depending into the neck of the container consisting of a plurality of circumferentially spaced, axially extending fingers 30 which extend downwardly from the inner edge of the disc portion 24 and which as illustrated in FIG. 2 are disposed in a circular array. An inverted internal cap member 34 is mounted over the opening defined by the trace of the fingers, the cap 34 having means for detachably securing it to the terminal ends of the fingers in the manner illustrated. To this end the cap 34 includes a generally disc-like bottom wall 36 which has a pair of radially spaced circumferential flanges 38 and 40 defining an annular pocket 42 within which the fingers nest. The outer flange 40 is provided with an inwardly directed projection 44 and an annular recess 46 spaced below the projection 44 to accommodate a lug 48 on the fingers and securely lock the cap against downward displacement relative to the fingers. The inner face of the bottom wall 36 is dished inwardly and is provided with a central opening 50 so that when the bottle is placed in an upright position after use, liquid may return through the opening 50 to the body of the container. The diameter of the cap 34 as illustrated is smaller than the internal diameter of the neck of the container to provide an annular flow passageway 35 for liquid from the container to the window-like openings 54 defined by the fingers 30.

The pouring adaptor further includes a head portion 56 in the form of a cylindrical extension 58 aligned with the circular trace of the fingers and projecting upwardly from the central ring portion 24 which terminates in an outwardly directed frusto-conical pouring lip 60 adapted to sealingly engage the outer closure cap as described below. As illustrated, the cylindrical extension 58 has a circumferentially extending bead 62 on its inner wall which serves as a detent engaging in a groove in the outer closure cap to maintain the outer closure and adaptor as a unit.

The outer closure cap 70 comprises a disc-like top 72, and a cylindrical skirt 74 depending from the outer peripheral edge of the top, the skirt 74 having internal screw threads 76 mating with the threads on the neck of the container. In the present instance, the outer closure cap is provided with circumferentially extending, radially spaced inner and outer flanges 78 and 80 which depend from the under surface of the top 72. The inner flange 73 engages interiorly of the head portion 56 of the pouring adaptor and is provided with a circumferential groove 82 within which the detent 62 on the inner wall of the head portion engages to retain the pouring adaptor and outer closure cap as a unit. The groove and bead arrangement in combination provide a detachable locking means for maintaining the outer closure cap and adaptor as an integral unit. The outer flange 80 is of a predetermined depth or height so that it sealingly engages with the central disc portion 24 of the adaptor when the parts are in the assembled relation shown. The inner face of the top 72 of the outer closure has a circumferential recess 88 outboard of the inner flange 78 within when the lip 60 of the adaptor seats.

The outer closure cap and pouring adaptor are preferably made of a resilient material such as polyethylene so that the parts may be economically produced by conventional molding techniques. The outer closure cap is preferably made of rigid to semi-rigid material and the adaptor of a material not as rigid as the outer cap to provide for case of assembly and to insure good sealing in the seal areas. This also facilitates assembly of the elements of the pouring adaptor to the outer closure cap by automatic assembly equipment.

In view of the above, the combination pouring adaptor-closure may be simply applied to the filled container, it being noted that the locking rib 28 on the pouring adaptor simply snaps into place in the groove 22 of the container when the closure cap 70 is threaded onto the neck of the container and is fully seated. It is noted that the adaptor-closure unit lends itself to assembly to a bottle by automatic assembly techniques or systems. Further, the chance of disassembly of the adaptor and outer cap during passage through the automatic capping equipment is minimized by reason of the fact that the adaptor nests in the outer cap and does not extend beyond the lower edge of the skirt of the outer cap. Additionally, the configuration is suitable for proper indexing or orientation prior to assembly to a bottle by the automatic system. In the fully assembled position, the contents of the container are effectively sealed in several locations. The skirt of the outer closure cap abuts the shoulder 16 on the neck of the container to provide a seal area. The inner and outer flanges of the cap provide seal areas as well as the snug engagement of the pouring adaptor on the neck of the bottle. Now when it is desired to pour the contents of the container, the outer closure is simply rotated and, by reason of the fact that the engagement of the bead 28 in the groove 22 provides a firmer seating action than the interengagement of the detent 62 in the groove 82 of the inner flange 78, the outer cap is released from the pouring adaptor and the pouring adaptor remains in place on the container.

Figure 5:
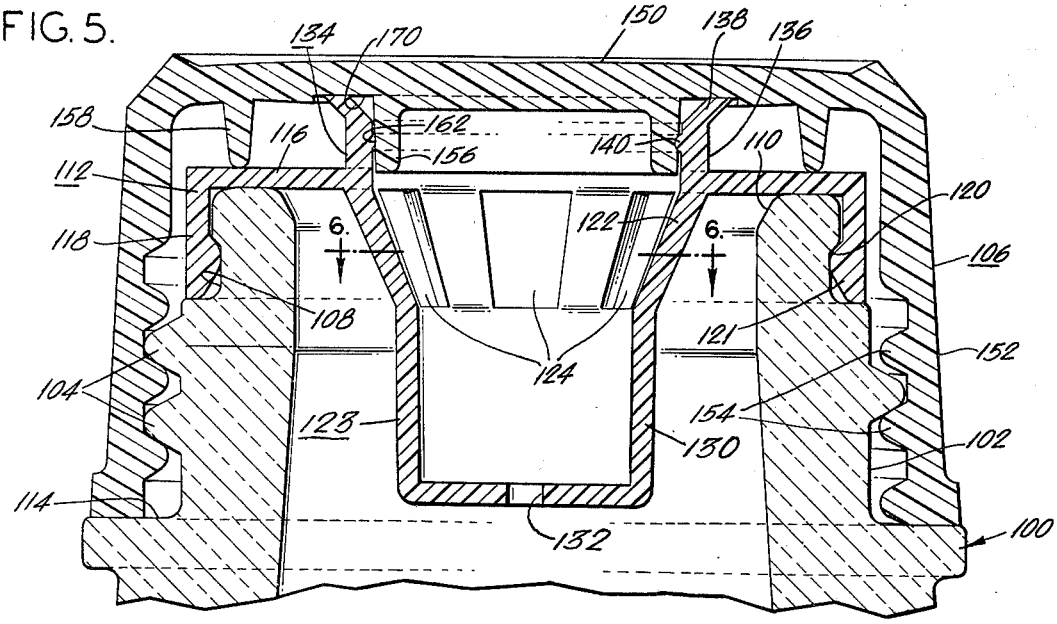
FIG. 5 is a view similar to FIG. 1 of another embodiment of closure-pouring adaptor assembly in accordance with the present invention.
Figure 6:
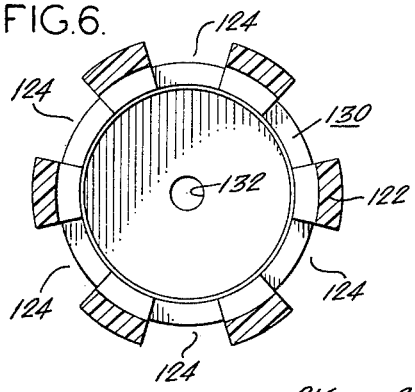
FIG. 6 is a sectional view taken on line 6—6 of FIG. 5.
Figure 8:
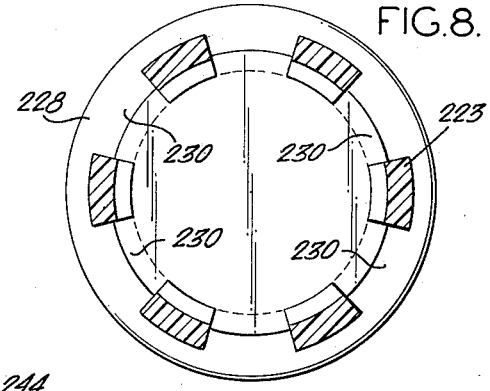
FIG. 8 is a sectional view taken on line 8—8 of FIG. 7.

There is illustrated in FIGS. 5 and 6 a second embodiment of combination pouring adaptor-closure assembly in accordance with the present invention. This embodiment is generally of the type described above and is adapted to be mounted as a unit on a container such as a bottle. The container, which is generally designated by the numeral 100, has a reduced neck portion 102 with exterior spiral threads 104 to mount the outer closure cap 106. An annular groove 108 is provided adjacent the discharge opening 110 in the container for seating the pouring adaptor or fitment 112. Below the spiral threads, the container has a circumferentially extending shelf 114 confronting the lower terminal edge of the skirt of the cap in the fully closed position.

The pouring adaptor 112 comprises a ring-like central disc portion 116 which has a depending cylindrical skirt 118 at its outer periphery, the skirt 118 having an enlarged inwardly directed locking rib 120 adjacent its lower terminal edge which engages in the annular groove 108 to firmly seat the pouring fitment over the open end of the container. The pouring adaptor is preferably made of a resilient material such as polyethylene, and the locking rib 120 is chamfered at its lower extremity as at 121 to permit the pouring adaptor to be snapped over the open end of the container and firmly seat the rib 120 in the annular groove 108. The pouring adaptor further includes a lower section 123 consisting of an inwardly divergent frusto-conical wall section 122 depending from the inner edge of the central disc portion 116, the frusto-conical wall section 122 being provided with a series of circumferentially spaced, trapezoidally shaped window openings 124 providing discharge ports for the liquid contents of the container. Formed integrally with the frusto-conical wall portion is a cuplike bottom section 130 which has a central opening 132 in its bottom wall to permit drainage of liquid contents back into the container when the container is positioned in an upright manner after use.

The pouring fitment 112 also includes a head portion generally designated by the numeral 134 in the form of a short cylindrical extension 136 projecting axially upwardly from the central disc portion 116 terminating in an outwardly directed pouring lip 138 providing a seal with the cap in the manner described below. The inner wall of the cylindrical extension 136 has an inwardly directed rib 140 serving as a detent which cooperates with the cap in a snap action manner to maintain the cap and pouring fitment as an integral assembly and permit the closure and adaptor to be assembled to a container as an integral unit.

The outer closure cap as illustrated has a disc-like top 150 and a cylindrical skirt 152 with conventional spiral threads 154 to cooperate with the threads on the container to permit the cap to be assembled in a conventional manner to the container. The cap is provided with a pair of axial circumferentially extending, radially spaced inner and outer flanges 156 and 158 respectively. The outer flange is of a depth in relation to the head portion of the pouring fitment so that it engages the top surface of the disc portion 116 to provide a seal therebetween. The inner flange has a circumferentially extending groove 162 to receive the detent 140 of the head portion thereby permitting the cap and pouring fitment to be held together as a unit. In the assembled relation the feathered lip 138 engages in an annular recess 170 in the cap adjacent the inner flange and outboard thereof to provide a seal at this juncture.

The pouring adaptor-closure assembly of the present invention is of extremely simplified construction and is economical to mass produce employing automatic assembly techniques. For example, the pouring fitment and cap are molded pieces which may be preassembled as units by automatic assembly systems wherein the outer closure cap is positioned over the head portion of the pouring fitment and the rib and annular groove engaged to retain the parts as a unit prior to application to the container. The assembled units, particularly by reason of the fact that the pouring adaptor lies within the confines of the cap, are retained together as a unit during normal handling and packaging prior to use. The units are easily assembled to a filled container simply by threading the cap over the open end of the container. When the cap is fully seated, the skirt of the pouring fitment snaps over the upper axial end of the container until the rib 120 seats in the annular groove 108. Now when it is desired to pour the liquid contents of the container, the cap 106 is simply threaded axially outwardly. In doing this, the pouring adaptor remains seated in the position shown by reason of the fact that there is a greater seating force produced by engagement of the locking rib 120 in the groove 108 as compared to the detent 140 on the head portion of the fitment and the groove 162 in the inner flange of the cap.

Figure 7:
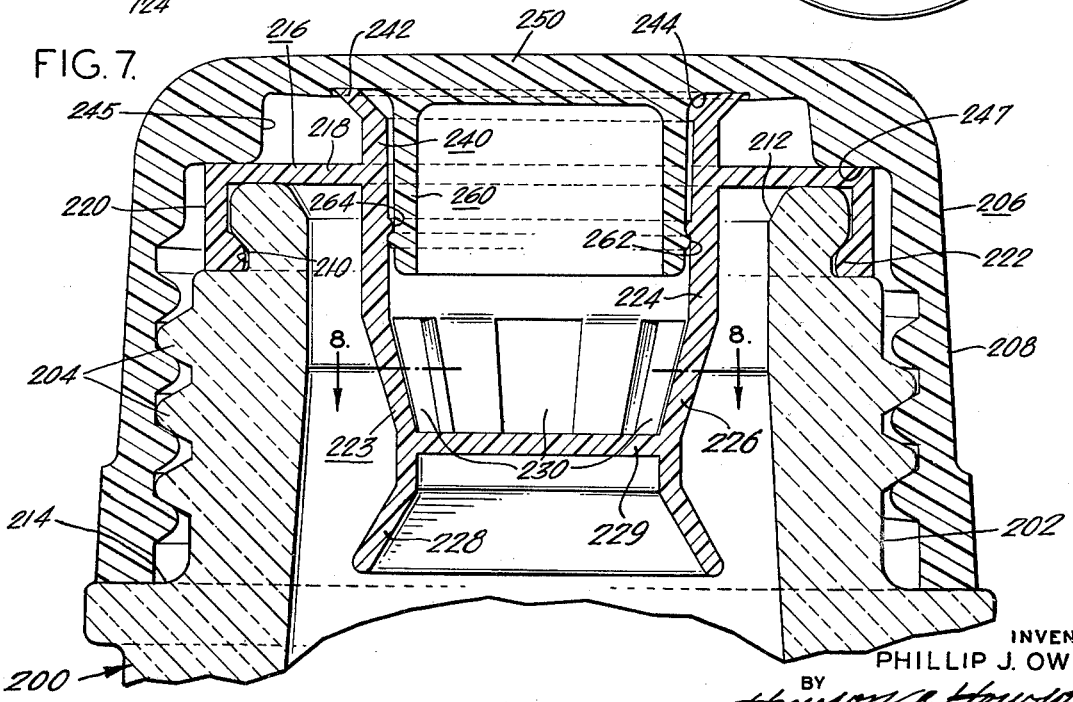
FIG. 7 is an elevational sectional view of still another embodiment of closure-pouring adaptor combination in accordance with the present invention.

There is illustrated in FIG. 7 a combination pouring adaptor-closure assembly in accordance with the present invention which is a modified version of the previously described embodiments. The container, which is generally designated by the numeral 200, is identical to that described in connection with the previous embodiments and includes a reduced neck portion 202 having external spiral threads 204 which cooperate with the internal threads of the outer closure cap 206. The container also has an outer annular shelf 214 confronting the lower edge of the skirt 208 of the cap in the fully closed position. There is provided an annular groove 210 adjacent the access opening 212 of the container which provides means for retaining the pouring adaptor 216 in place.

In the present instance the pouring adaptor comprises a ring-like disc portion 218 having a skirt 220 depending from its outer periphery which terminates at its lower end in a radially inwardly directed circumferentially extending locking rib 222 which seats in the groove 210 in the neck of the bottle. Since the adaptor is preferably made of a flexible resilient material and due to the configuration of the locking bead, there is a camming action when the adaptor is positioned over the neck of the container and pressed downwardly which flexes the skirt 220 outwardly to seat the locking rib 222 in the groove 210.

The pouring adaptor includes a lower section 223 consisting of a short cylindrical collar 224, an inwardly directed frusto-conical center section 226, an outwardly flared splash baffle 228, and a disc-like bottom wall 229 at the juncture of the center section 226 and baffle 228. The center section is provided with circumferentially spaced window-like openings 230 through which the liquid is discharged. The head section 240 of the adaptor terminates in an outwardly directed feathered lip 242 which seats in a pocket 244 of the outer closure cap.

The top of the outer closure cap as illustrated has a corner fillet 245 adjacent the juncture of the top 250 and skirt 208 having a radial face 247 which presses against the outer edge of the disc portion 218 of the adaptor when the cap is fully seated. Additionally, the cap has a depending cylindrical inner flange 260 having a radially outwardly directed bead 262 which in the closed position engages under a bead 264 on the cylindrical wall 224 of the pouring adaptor. The restraining influence of the interengaging detents 262 and 264 in relation to the seating action of the locking rib 222 in the groove 210 is such that the cap may be removed from the neck of the container without unseating the adaptor in the same fashion as the previously described embodiments. Additionally, the corner fillet 245 is of a predetermined depth in relation to the interengaging position of the detents 262 and 264 to provide a corner seal with the adaptor. In the present instance the splash baffle 228 is continuous, and the lower terminal edge thereof is preferably spaced from the inner wall of the neck of the container a predetermined distance of no more than about 0.020 inches to provide optimum pouring characteristics.

Figure 9:
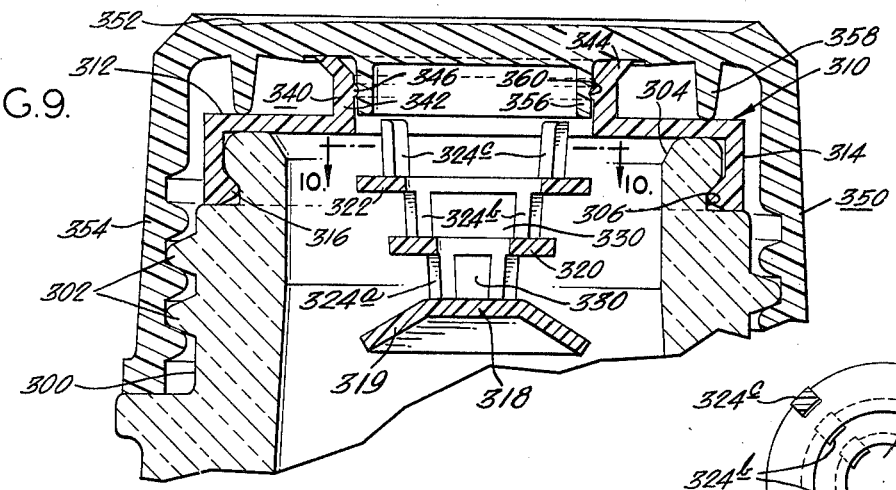
FIG. 9 is a sectional view of a further embodiment of closure-pouring adaptor assembly in accordance with the present invention.
Figure 10:
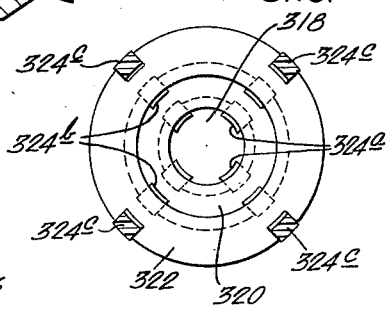
FIG. 10 is a fragmentary transverse sectional view taken on line 10—10 of FIG. 9.

There is illustrated in FIGS. 9 and 10 still a further embodiment of adaptor-closure combination in accordance with the present invention. This assembly is adapted to be applied to a container such as a bottle which is identical in construction to the container described in the previous embodiments. Thus, the container has a neck portion 300 having external spiral threads 302 to receive and support the closure cap which also has mating spiral threads. The container is of a reduced cross section adjacent the discharge opening 304 and is shaped to provide an external circumferentially extending locking groove 306.

The adaptor 310 comprises a ring-like central disc portion 312 having a circumferential skirt 314 depending from its outer edge which terminates at its lower end in an inwardly directed locking bead 316 which seats in the locking groove 306 in the container to support the adaptor in place over the open end of the container. In the present instance, the lower section of the adaptor is of a tiered or stepped configuration comprising, as illustrated, a disc-shaped bottom wall 318 and a pair of intermediate ring-shaped landings 320 and 322, the bottom wall and landings being supported in axially spaced relation by means of, in the present instance, circumferentially equi-spaced connecting posts 324, the posts connecting the disc to the intermediate ring member 320 being designated 324*a*, the posts connecting the intermediate ring members 320 and 322 being designated 324*b*, and the posts connecting ring member 322 to the central disc 310 being designated 324*c*. As illustrated, these posts define a plurality of window-like openings 330, the size of the openings in each tier varying in size relative to one another. The bottom wall or disc 311 has an outwardly divergent splash baffle 319 extending from its periphery. This construction and arrangement breaks up the flow of fluid through the adaptor in a manner to prevent splashing and thereby insuring a controlled smooth flow through the outer discharge end of the adaptor.

The head section 340 consists of a short cylindrical extension projecting upwardly from the central disc member 310 which section 342 terminates in an outwardly flared discharge lip 344 similar to the previously described embodiments. In the present instance, the inner wall of the cylindrical section 342 is provided with a plurality of circumferentially spaced lugs 346 serving as detents for maintaining the adaptor and outer closure cap in the assembled relation.

The outer closure cap 350 is identical in construction and arrangement to the closure cap shown in FIG. 1 including a top 352, a depending skirt 354, and radially spaced inner and outer flanges 356 and 358 respectively, the inner flange having a groove 360 formed therein within which the detents 346 seat when the outer closure cap is assembled to the adaptor.

Figure 11:
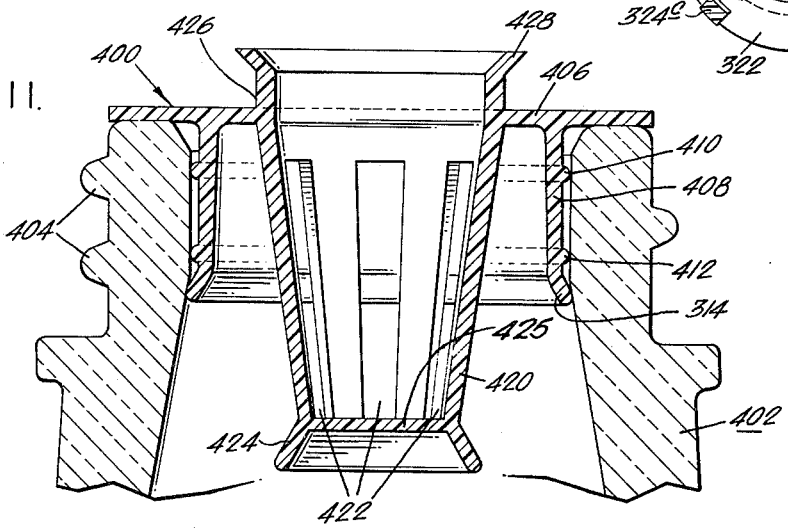
FIGS. 11 and 12 are elevational views of additional embodiments of pouring adaptors or fitments in accordance with the present invention.
Figure 12:
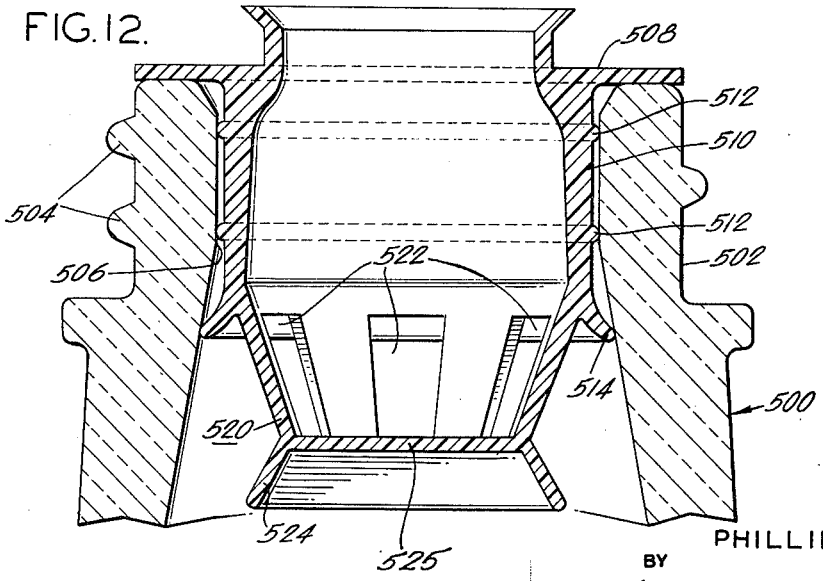

There are illustrated in FIGS. 11 and 12 other embodiments of pouring adaptors in accordance with the present invention. These adaptors are also adapted for assembly to a filled bottle by automatic equipment systems prior to application of a conventional screw type outer cap (not shown).

The adaptor 400 includes a central ring-like disc member 406 having a depending skirt 408 with a pair of axially spaced ribs 410 and 412 adapted to snugly engage the interior wall in the neck of the container to prevent leakage of liquid past this portion of the fitment. The skirt terminates in an outwardly flared lip 414 which engages the container at the juncture where the container neck wides out and serves to securely hold the pouring adaptor in place against axial outward displacment. The lip also serves to firmly press the central disc member 400 against the axial end face of the container in the manner shown. In the present instance, the lower portion of the adaptor is an elongated downwardly converging member 420 having circumferentially spaced window-like openings 422, the lower section terminating in an outwardly directed baffle 424. A bottom wall 425 of disc like shape is disposed at the juncture of the splash baffle 424 and member 420. The head section of the fitment includes a short cylindrical projection 426 terminating in an outwardly flared pouring lip 423, the top edge of which is flat so that it provides a seal against the flat top of a conventional cap applied to the container when it is not in use.

The adaptor shown in FIG. 12 is for use on a container such as a bottle of identical construction to the bottle shown and described in FIG. 11. Thus, the bottle, which is generally designated by the numeral 500, includes a reduced neck portion 502 having spiral threads 504 for mounting a conventional cap. The inner wall of the neck tapers outwardly as at 506 to seat the adaptor in the manner set forth below.

The adaptor includes a central ring-like disc member 508 having a depending skirt 510 with axially spaced ribs 512 which engage the neck of the bottle to prevent leakage of liquid during the pouring operation. The skirt terminates in an outwardly directed flared lip 514 which engages below the juncture 506 and secures the adaptor against accidental outward displacement. In the present instance, the skirt terminates in a frustoconical inwardly directed wall section 520 having window-like openings 522 through which the liquid is discharged. The wall section 520 has an outwardly directed baffle 524 at its lower end which serves to prevent splashing of the liquid when the container is placed in a pouring position. The bottom adaptor has a disc like bottom wall 525 at the juncture of the baffle 524 and section 520.

Figure 13:
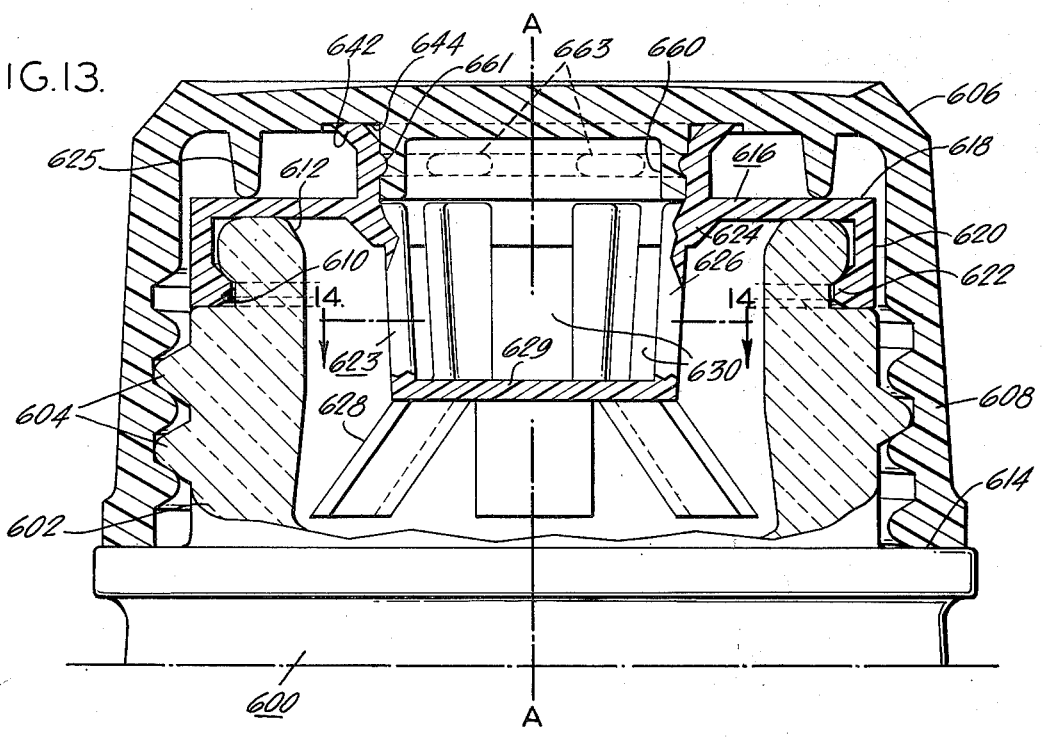
FIG. 13 is an elevational sectional view of still another embodiment of pouring adaptor-closure assembly in accordance with the present invention.
Figure 14:
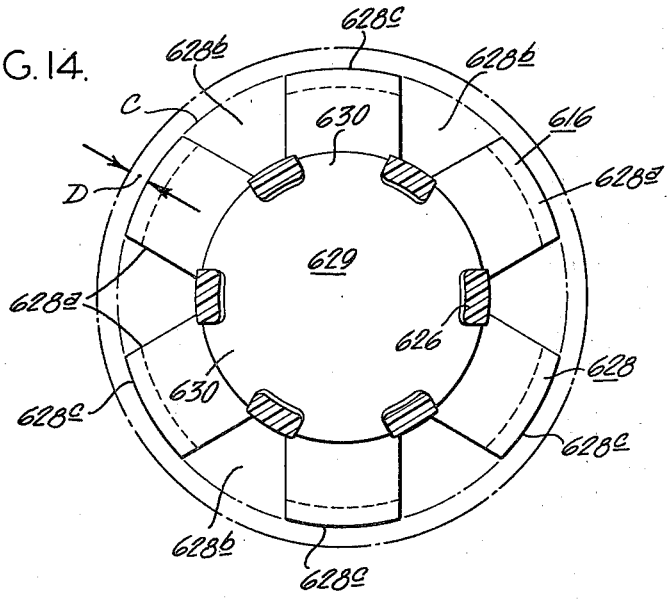
FIG. 14 is a sectional view taken on lines 14—14 of FIG. 13.

There is illustrated in FIGS. 13 and 14 another embodiment of pouring adaptor-closure assembly in accordance with the present invention. The container, which is generally designated by the numeral 600, is similar to that described in connection with the previous embodiments and includes a reduced neck portion 602 having external spiral threads 604 which cooperate with the internal threads of the outer closure cap 606. The container also has an annular outer shelf 614 confronting the lower edge of the skirt 608 of the cap in the fully closed position. There is provided an annular groove 610 adjacent the access opening 612 of the container which provides means for retaining the pouring adaptor 616 in place.

In the present instance the pouring adaptor comprises a ring-like disc portion 618 having a skirt 620 depending from its outer periphery which terminates at its lower end in a radially inwardly directed circumferentially extending locking rib 622 adapted to seat in the groove 610 in the neck of the bottle to hold the adaptor in place. As in the previously described embodiments, the adaptor is preferably made of a flexible resilient material which combined with the configuration of the locking bead produces a camming action when the adaptor is positioned over the neck of the container and pressed downwardly. This tends to flex the skirt 620 outwardly to seat the locking rib 622 in the groove 610.

The pouring adaptor includes a lower section 623 consisting of a short cylindrical collar 624, an inwardly directed frusto-conical center section 626, an outwardly flared splash baffle 628, and a disclike bottom wall 629 at the juncture of the center section 626 and baffle 623. The center section is provided with circumferentially spaced windowlike openings 630 through which the liquid is discharged. The head section 640 of the adaptor terminates in an outwardly directed feathered lip 642 which seats in a pocket 644 of the outer closure cap. In the present instance, the splash baffle 628 comprises a plurality of circumferentially equispaced tabs 628*a*, each tab being of generally rectangular cofiguration having parallel radial side edges to define generally triangular shaped openings 628*b* between each of the adjacent tabs 628*a*. These triangular shaped openings 628*b* are staggered in relation to the windowlike opening 630 to provide a slightly tortuous path for the flow of liquid through the adaptor. The interrupted baffle provided by the tab arrangement allows venting air to pass freely thereby producing an even flow of liquid regardless of which position the bottle is held to pour. It has been found that this construction provides for smooth flow, one in which spurt and "glugging" are controlled in a desired manner. It is noted that the bottom wall 629 is disposed at the lower edge of the windowlike openings and that the splash guard baffle tabs emanate from the bottom wall 629. Each of the tabs 628*a* is disposed at a predetermined angle of between 35° and 40° relative to the central axis A-A of the adaptor. The free terminal end edges 628*c* of each tab are curved or arcuate and lie on the circumference of a circle C. The end edges 628*c* are preferably spaced from the inner wall of the neck of the containers predetermined distance D of no more than about 0.020 inches to provide optimum pouring characteristics. It has been found that with this spacing the flow of liquid from the adaptor is relatively uniform and there is no tendency to "spurt."

The top of the outer closure cap illustrated has a seal in the form of a corner fillet 625 which presses against the outer edge of the disc portion 618 of the adaptor when the cap is fully seated. Additionally, the cap has a depending cylindrical inner flange 660 which in the present instance is provided with a circumferentially extending groove 661 on its outer periphery. The groove is spaced relative to a plurality of circumferentially spaced locking ribs 663 on the head section 660 of the adaptor so that when the adaptor is assembled and the lip 642 engages the top of the cap, the locking ribs engage in the groove to hold the parts together. It is noted the restraining influence of the interengaging ribs 663 and groove in relation to the seating action of the locking rib 662 is such that the cap may be removed from the neck of the container without unseating the adaptor, in a manner similar to the arrangements described previously. The segmented arrangement of ribs 663 provides for a more controlled releasing action. Additionally, the axial length of the adaptor in the present instance is shorter than the depth of the outer cap to facilitate assembly of the parts by automatic equipment and preclude separation thereof as they are processed in automatic cap assembly The window openings 630 are preferably of a size to afford a predetermined flow rate of about 40 ounces per minute through the adaptor.

What is claimed is:

1. The combination of a pouring adaptor and a closure for use on a container for liquid products, said adaptor comprising a central portion having means for securing the adaptor over the discharge opening in the container, a lower section depending into the container having a plurality of window-like discharge openings of a size and shape to control discharge of fluid therethrough and an upper head section terminating in an outwardly directed lip, said closure including a top and a skirt depending from the outer peripheral edge of the top with means for detachably mounting the closure over the open end of the container, said closure and adaptor having detachable retaining means normally maintaining the adaptor and closure assembled as a unit and operable to release the closure from the adaptor when the closure is removed from the container without unseating the adaptor, said detachable retaining means including at least one member depending from the top of said closure engageable with said upper section, said lip of the upper section engageable with the inside top surface of said closure when the closure and adaptor are interengaged to provide a seal therebetween.

2. The combination as claimed in claim 1 wherein said one member is a circumferentially extending flange engaging interiorly of said upper section.

3. The combination as claimed in claim 1 wherein said closure includes inner and outer circumferentially extending radially spaced flanges depending from the inner face of said top, said inner flange and head section having retaining means for maintaining the closure and adaptor as a unit and the lower terminal edge of said outer flange engageable with said disc portion.

4. The combination as claimed in claim 1 wherein said lower section comprises a plurality of circumferentially spaced axially extending fingers which extend downwardly from the inner edge of said portion and an inverted internal cap member mounted over the opening defined by the trace of the fingers, said internal cap member including a generally disc-like bottom wall having a pair of radially spaced circumferential flange members defining a pocket within which the fingers nest, the outer flange having an annular recess and each of the fingers having a lug engageable in the recess to detachably secure the cap member in place.

5. The combination as claimed in claim 1 wherein said closure includes at least one flange depending from the inner face of the top having a circumferential groove therein and said head section includes a circumferential bead adapted to engage in said groove to provide retaining means.

6. The combination as claimed in claim 1 wherein said closure includes inner and outer circumferentially extending radially spaced flanges depending from the inner face of said top, said inner flange and head section having retaining means for maintaining the closure and adaptor as a unit and the lower terminal edge of said outer flange engagable with said central portion.

7. The combination as claimed in claim 1 wherein said container includes a groove adjacent said open end and said center portion has a skirt at its outer periphery with a locking rib which seats in said groove.

8. The combination as claimed in claim 1 wherein the lower section comprises a plurality of circumferentially spaced axially extending fingers which extend downwardly from the inner edge of said central portion and an inverted internal cap member mounted over the opening defined by the trace of the fingers.

9. The combination as claimed in claim 8 wherein said internal cap member includes a generally disc-like bottom wall having a pair of radially spaced circumferential flange members defining a pocket within which the fingers nest, the outer flange having an annular recess and each of the fingers having a lug engagable in the recess to detachably secure the cap member in place.

10. The combination as claimed in claim 9 wherein the bottom wall of the internal cap member is dished inwardly and is provided with a central opening to facilitate return of liquid when the container is in an upright position.

11. The combination as claimed in claim 1 wherein the lower section consists of an inwardly divergent frusto-conical wall section depending from said inner edge of the central portion, said wall section having a series of circumferentially spaced trapezoidally-shaped window-like discharrge openings and a cup-like bottom section having a central opening in its bottom wall which depends from the frusto-conical wall section.

12. The combination as claimed in claim 1 wherein said closure includes at least one flange depending from the inner face of the top and having adjacent its lower edge a first detent which engages under a second detent formed integrally with an adaptor to retain the closure and adaptor as a unit.

13. The combination as claimed in claim 1 wherein the lower section is of a stepped configuration comprising a discshaped bottom wall and at least one intermediate ring-shaped landing, the bottom wall and landing being supported in axially spaced relation to one another and to said central disc portion by means of circumferentially spaced connecting posts, said connecting posts defining a plurality of window-like openings wherein the openings in each tier vary in size relative to one another.

14. The combination as claimed in claim 1 wherein the skirt of the closure is of a height greater than the depth of the adaptor when the parts are assembled as a unit.

15. The combination as claimed in claim 4 wherein the bottom wall of the internal cap member is dished inwardly and is provided with a central opening.

16. The combination as claimed in claim 1 wherein said lower section including an outwardly flared splash guard means and wherein the outer terminal edge of the splash guard is spaced from the inside wall of the container a distance of no more than about 0.020 inches.

17. The combination as claimed in claim 1 wherein said member is provided with a groove and said upper section includes detent means engageable in said groove, the groove and detent means providing said detachable retaining means.

18. The combination as claimed in claim 1 wherein the largest diametral dimension of said adaptor is slightly smaller than the smallest internal diametral dimension of the skirt of said closure whereby upon assembly of the adaptor to the closure, the member of said adaptor engages interiorly of said flared lip.

19. The combination as claimed in claim 1 wherein said closure includes an outer circumferentially extending sealing flange engageable with the central portion.

20. The combination as claimed in claim 1 wherein said one member is a circumferentially extending flange engaging interiorily of said upper section.

21. The combination as claimed in claim 20 wherein said flange has a groove in its outer peripheral surface and the upper section includes at least one projection engageable in said groove, said detent and groove comprising said detachable retaining means.

22. The combination as claimed in claim 20 wherein said flange and upper section have interengaging projections comprising the detachable retaining means.

23. The combination as claimed in claim 1 wherein said lower section is of stepped configuration comprising a disc-shaped bottom wall and at least one intermediate ring-shaped landing, the bottom wall and landing being supported in axially spaced relation to one another and to said central portion by means of circumferentially spaced connecting posts, said connecting posts defining a plurality of window-like openings wherein the openings in each tier vary in size relative to one another.

24. A pouring adaptor adapted to be mounted over the open end in a container for liquid products comprising a central portion having means for securing the adaptor over the discharge opening in the container, a lower section depending into the container having a plurality of window-like discharge openings of a size and shape to control discharge of fluid therethrough and an upper section terminating in an outwardly flared lip, said lower section including a bottom wall and splash guard means consisting of a plurality of tabs circumferentially spaced to define openings between adjacent tabs and each tab being generally aligned with said window-like discharge openings and having at least a portion thereof extending below the plane of the bottom wall.

25. A pouring adaptor as calimed in claim 24 wherein said tabs are outwardly flared.

26. A pouring adaptor adapted to be mounted over the open end in a container for liquid products comprising a central portion having means for securing the adaptor over the discharge opening in the container, a lower section depending into the container having a bottom wall, a plurality of window-like discharge openings of a size and shape to control discharge of fluid therethrough and extending to a depth aligned with said bottom wall and an upper section terminating in an outwardly flared lip, said lower section including outwardly flared splash guard means consisting of a plurality of tabs circumferentially spaced to define openings between adjacent tabs, each tab being generally aligned with said window-like discharge openings and depending from said lower section at a point generally aligned with a plane including the bottom wall.

27. A pouring adaptor as claimed in claim 1 wherein said lower section is of generally cylindrical shape and said bottom wall is of generally disc-like form, said discharge openings extending to a depth aligned approximately with said bottom wall.

28. A pouring adaptor as claimed in claim 1 wherein said upper section is of generally cylindrical shape terminating in a continuous outwardly flared lip.

29. A pouring adaptor adapted to be mounted over the open end in a container for liquid products comprising a central portion having means for securing the adaptor over the discharge opening in the container, a lower section depending into the container having a plurality of window-like discharge openings of a size and shape to control discharge of fluid therethrough and an upper section terminating in an outwardly flared lip, said lower section including a bottom wall and splash guard means consisting of a plurality of tabs circumferentially spaced to define openings between adjacent tabs and having at least a portion thereof extending below the plane of the bottom wall.

30. The combination of a pouring adaptor and a closure for use on a container for liquid products, said adaptor comprising a central portion having means for securing the adaptor over the discharge opening in the container, a lower section depending into the container having a plurality of window-like discharge openings of a size and shape to control discharge of fluid therethrough and an upper section terminating in an outwardly flared lip and having means for detachably securing the adaptor to the closure, said closure including a top having a skirt depending from its outer peripheral edge with means for detachably mounting the closure over the open end of the container, said closure and adaptor having detachable retaining means normally maintaining the adaptor and closure assembled as a unit and operable to release the closure from the adaptor when the closure is removed from the container without unseating the adaptor, said detachable retaining means including a flange member depending from the top of said closure engageable with said upper section of said adaptor, said flange and upper section having interengaging means detachably retaining said adaptor and closure as an assembly and the outer terminal edge of said outwardly flared lip engaging the inside top surface of said closure when the adaptor and closure are interengaged to provide a seal therebetween.

31. The combination of a pouring adaptor and closure for use on a container for liquid products, said adaptor comprising a central portion having means for securing the adaptor over the discharge opening in the container, a lower section depending into the container having a plurality of window-like discharge openings of a size and shape to control discharge of fluid therethrough and an upper head section including an outwardly directed lip, said closure including a top and a skirt depending from the outer peripheral edge of the top with means for detachably mounting the closure over the open end of a container, said closure and adaptor having detachable retaining means normally maintaining the adaptor and closure assembled as a unit and operable to release the closure from the adaptor when the closure is removed from the container without unseating the adaptor, said detachable retaining means including at least one member depending from the top of said closure engageable with said upper section, said lip of the upper section engageable with the inside surface of the top of said closure when the closure and adaptor are interengaged to provide a seal therebetween.

* * * * *